US007044626B2

(12) United States Patent
Randak

(10) Patent No.: US 7,044,626 B2
(45) Date of Patent: May 16, 2006

(54) IMAGE DISPLAY UNIT

(76) Inventor: Charles Stefan Randak, 27 Milngavie Road, Glasgow G62 6AQ (GB)

( * ) Notice: Subject to any disclaimer, the term of this patent is extended or adjusted under 35 U.S.C. 154(b) by 412 days.

(21) Appl. No.: 10/415,190

(22) PCT Filed: Oct. 26, 2001

(86) PCT No.: PCT/GB01/04752

§ 371 (c)(1),
(2), (4) Date: Apr. 25, 2003

(87) PCT Pub. No.: WO02/35508

PCT Pub. Date: May 2, 2002

(65) Prior Publication Data

US 2004/0055196 A1 Mar. 25, 2004

(30) Foreign Application Priority Data

Oct. 28, 2000 (GB) ..... 0026418.4

(51) Int. Cl.
*F21V 7/04* (2006.01)
*G09F 13/00* (2006.01)

(52) U.S. Cl. ..... 362/604; 362/353; 362/355; 362/632; 40/541; 40/617

(58) Field of Classification Search ..... 362/353, 362/604–607, 614, 351, 355, 632–634, 559, 362/812; 40/541, 617
See application file for complete search history.

(56) References Cited

U.S. PATENT DOCUMENTS

| | | | | |
|---|---|---|---|---|
| 1,603,311 | A * | 10/1926 | Brett et al. | 40/607.01 |
| 4,835,661 | A * | 5/1989 | Fogelberg et al. | 362/97 |
| 5,390,436 | A * | 2/1995 | Ashall | 362/618 |
| 5,414,599 | A | 5/1995 | Kaneko et al. | 362/31 |
| 5,647,655 | A | 7/1997 | Kashima et al. | 362/31 |

FOREIGN PATENT DOCUMENTS

| | | |
|---|---|---|
| CH | 690 312 A | 7/2000 |
| EP | 0 446 739 A | 9/1991 |

* cited by examiner

*Primary Examiner*—Ali Alav
*Assistant Examiner*—Bao Q. Truong
(74) *Attorney, Agent, or Firm*—Frank J. Dykas; Dykas, Shaver & Nipper

(57) ABSTRACT

An image display unit 10 comprises a light source 14 and a light diffusing panel 18, over which is mounted an opposed pair or retaining sheets 20 with a volume 22 formed between each retaining sheet 20 and the panel 18 for receiving an image-bearing sheet 34. An elongate opening 26, 28 for providing access to the volume 22 formed in each face of the unit 10 is located spaced from the edges of the unit 10, so allowing a user to access the volumes 22 regardless of proximity of the edges of the unit 10 to other units, or to a wall or the like.

15 Claims, 2 Drawing Sheets

IMAGE DISPLAY UNIT

Figure 1:
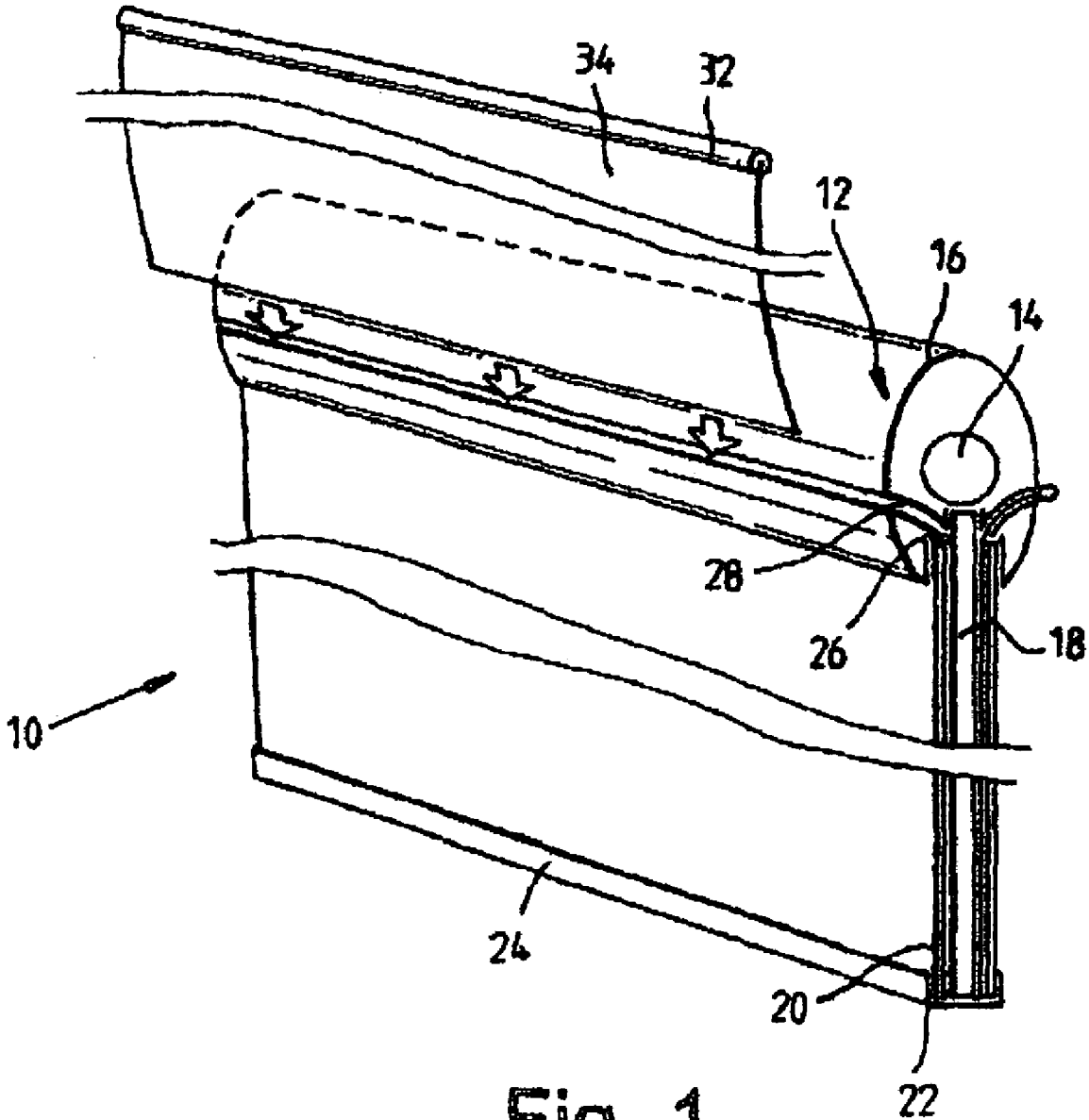

The present invention relates to a display unit for displaying images. More particularly, the invention relates to a display unit for displaying images mounted on sheets of paper and the like. The invention also relates to an image display system incorporating ouch units. Certain embodiments of the invention relate to illuminated sign display units.

Illuminated signs are a generally convenient manner of displaying information, particularly advertising information. One particular illuminated sign in common use takes the form of a light box or similar arrangement incorporating light sources such as fluorescent tubes or the like, with a printed sheet of graphics mounted over the light sources, such that light passes through the printed sheet and illuminates the graphics. Use of printed sheets allows the sign to be changed from time to time, by replacing the sheet.

Such arrangements, however, suffer from a number of disadvantages. Firstly, the location of the printed sheet immediately adjacent the fluorescent tubes may cause unsightly visual effects—often the variation in light intensity between tubes, and in the spaces between tubes, is sufficient to be visible through the printed sheet. In order to reduce these effects, it is necessary to increase the depth of the light box to separate the sheet from the fluorescent tubes. Further, replacement of the printed sheet can be awkward. Typically an outer retaining cover must be removed from the light box to release the sheet, after which a fresh sheet is placed against the light box, and the retaining cover replaced. As the retaining cover must be removed, the printed sheet may fall from the light box, or may have creases or folds accidentally incorporated therein during sheet replacement. The removal and replacement of printed sheets may thus require the presence of two or more people, to avoid such unwanted creases. Furthermore, as light boxes are often ceiling-mounted, these operations may have to be carried out by persons on stepladders or a raised platform.

Other display units are known in which a retaining cover is permanently or semi-permanently attached to the light box, with an opening in the form of a slot provided through which printed sheets may be inserted or removed. Such an arrangement allows sheets to be replaced without requiring the removal of the retaining cover, and so sheets may be replaced by only a single operator. However, these slots are generally located at one edge of the unit, whereby the requirement for access to the slots restricts the possible locations of such display units, particularly the possibility of mounting a number of such units in close proximity to one another. In addition, the relatively bulky nature of light boxes further limits the freedom of location of such display units.

It is among the objects of embodiments of the present invention to obviate or alleviate these and other disadvantages of known image display units.

According to a first aspect of the invention, there is provided an image display unit having a face for displaying an image, the unit comprising a light source, and retaining means for retaining an image adjacent the light source, the retaining means and the light source in combination defining a volume for receiving a sheet bearing an image, the volume having an elongate opening by which a sheet may be inserted into or removed from the volume, wherein the face has a number of edges, and the elongate opening is located within the face, and spaced from the edges thereof.

Thus, the present invention provides a display unit with an opening for allowing an image-bearing sheet to be replaced, which construction is easily operably by a single user. Further, the opening is located essentially within the image-displaying face of the unit, rather than at the edges of the unit. This allows a user to access the opening to change the sheet without requiring access to the edges of the unit, and so units in accordance with the present invention may be placed adjacent one another, or adjacent walls or other structures, without obstructing access to the opening for changing the image-bearing sheets.

The face may comprise the retaining means alone, or may comprise the retaining means and the light source, or a portion thereof, in combination.

Preferably the light source comprises a light producing means and a light diffusing means, the light diffusing means being located substantially adjacent to and overlapping with the retaining means. That is, the light diffusing means is largely co-extensive with the retaining means. The light producing means may be for example an incandescent light bulb, a fluorescent light, LEDs and the like. Although the light producing means may be located remotely from the remainder of the unit, it is preferred that the light producing means is integral with the unit, and is located towards an edge of the unit. Conveniently the light producing means is located in use at an upper or lower edge of the unit, preferably an upper edge. Where the light producing means is remote from the remainder of the unit, a plurality of units may be connected to a common light producing means, if desired. Preferably the light diffusing means is of polymeric-material; conveniently the diffusing means is an acrylic material; preferably the diffusing means is an acrylic material having a matrix of dots thereon arranged to allow interaction of light between surfaces of the material. Such material is described in U.S. Pat. Nos. 5,390,436, and 5,625,968, the contents of which are incorporated herein by reference; such material is marketed under the trade name PRISMEX (RTM). Use of a light diffusing material allows the body of the unit to be made relatively thin, so allowing the unit to be displayed in a restricted space. Preferably the light diffusing means has a substantially planar form; for example, a sheet of light diffusing material. The unit may further comprise a casing or the like for protecting the light producing means; the casing may further comprise any or all of: means for receiving and retaining the light diffusing means; means for receiving and retaining the retaining means; and means for guiding an image sheet to the opening of the unit.

The retaining means preferably has a substantially planar form, for example, that of a sheet of material. Preferably the retaining means has a substantially similar form to that of the light diffusing means, where present. The retaining means is preferably transparent or translucent, and is conveniently of glass, polymeric material, or the like. Preferably the retaining means is of acrylic material, and more preferably of PERSPEX (RTM) or the like. Conveniently the retaining means is of non-reflective material, to assist users to see the image displayed.

The retaining means may be formed in one piece with the light source, or may be separate, and secured thereto at one or more locations. Conveniently the retaining means is separate, and is secured to the light source by one or more end pieces which may be secured to both the light source and the retaining means.

Preferably the elongate opening is located towards an edge of the face, although not at an edge of the face. Preferably the elongate opening is located in use towards an upper edge of the face; this allows an image sheet to be inserted into the gap and lowered therein with the assistance of gravity, which serves to reduce the likelihood of folds or creases being introduced into the sheet, and further assists in ensuring the accurate alignment of the sheet.

Preferably the elongate opening is formed by a combination of a portion of the retaining means and a portion of the light source; conveniently the opening is formed by an edge of the retaining means and a portion of the light source. Where the light source comprises a light diffusing means and a light generation means, the elongate opening is conveniently formed between the retaining means and a section of the light generation means; alternatively, where the unit comprises a casing for the light source, the opening may be formed between the retaining means and the casing.

Preferably the unit comprises a second retaining means, volume, and opening located on an opposed side of the light source from the first retaining means, volume, and opening. This allows the unit to be mounted such that two faces of the unit are visible and display an image. Conveniently the two volumes are continuous, such that a single image sheet may be inserted into both volumes.

Preferably the unit further comprises a sheet bearing an image for display. The image may be laser printed, digitally printed, or the like; such techniques allow simple and rapid generation of replacement image sheets by users, and the display units may be altered frequently at relatively low cost; something which is not possible with conventional image display units. In certain embodiments of the invention, the sheet may comprise reinforcement means such as a gripper rod or the like along one edge of the sheet. Conveniently the opening of the unit is shaped to receive and retain the reinforcement means. This allows a user to grasp the sheet for insertion or removal from the unit, while also providing a defined location for the sheet in the unit to prevent insertion of the sheet too far into the unit.

According to a second aspect of the present invention, there is provided an image display unit having opposed faces for displaying images, the unit comprising a light source, and a pair of retaining means located on opposed sides of the light source for retaining images adjacent the light source, each retaining means and the light source in combination defining a volume for receiving a sheet bearing an image, the volume having an elongate opening by which a sheet may be inserted into or removed from the volume, wherein each face has a number of edges, and each elongate opening is located within a respective face, and spaced from the edges thereof.

According to a further aspect of the present invention, there is provided an image display sheet for use with an image display unit, the image display sheet comprising a substrate bearing an image thereon, and a reinforcing rod mounted to one edge of the substrate.

The substrate is preferably in sheet form, and may be of paper, fabric, acetate, vinyl, photographic paper, polymeric materials, and the like. The image is preferably digitally printed onto the substrate.

According to a yet further aspect of the present invention, there is provided an image display system of at least two aide-by-side units, each unit comprising a light source, a retaining means spaced from the light source, and a gap for receiving an image-bearing sheet of material, the gap being defined by the light source and the retaining means and open along one edge, the open edge extending substantially along the entire length of each unit for feeding the sheet into the gap so that the sheet may be illuminated by the light source.

Figure 2:
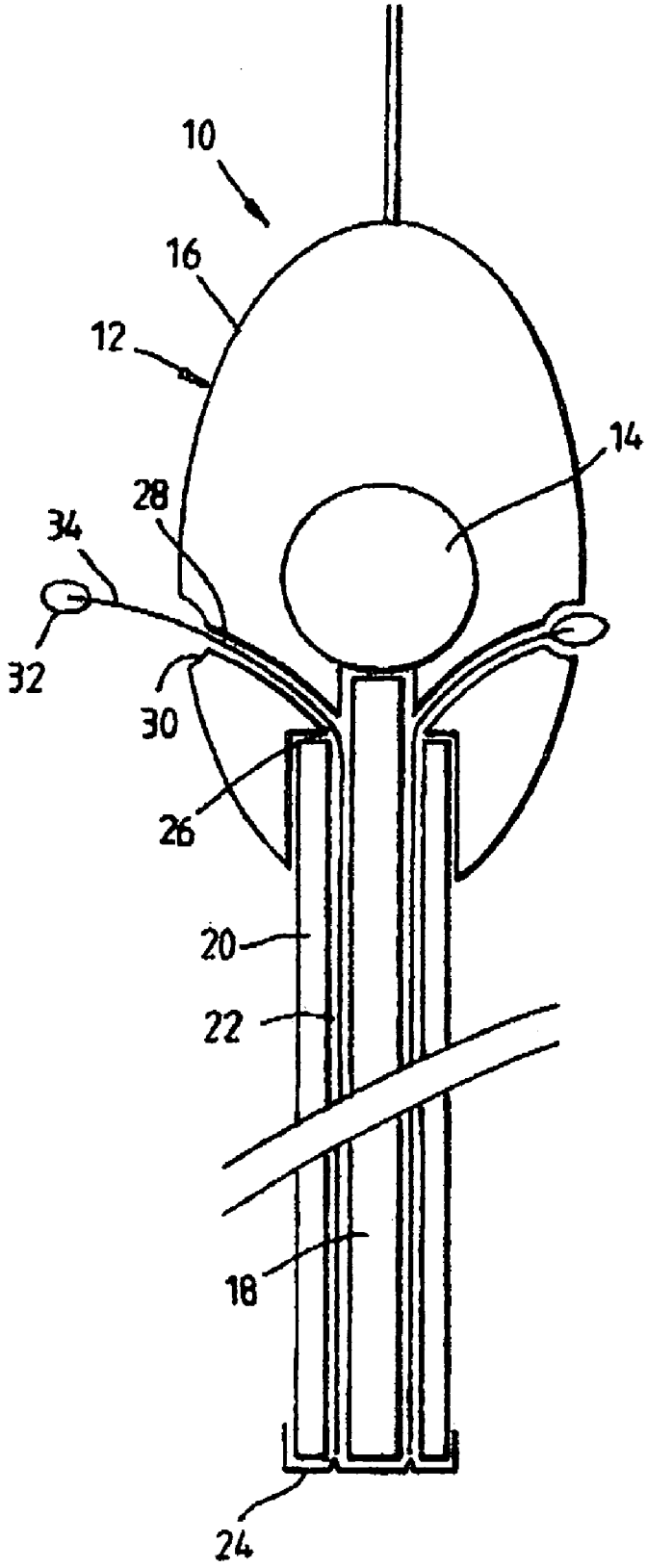

These and other aspects of the present invention will now be described by way of example only and with reference to the accompanying drawings, in which:

FIG. 1 shows a perspective view of a display unit in accordance with one embodiment of the present invention; and FIG. 2 shows a cross-sectional view of the display unit of FIG. 1.

Referring to the Figures, these show a display unit 10 in accordance with one embodiment of the present invention. The unit 10 comprises a light source 12 comprising a fluorescent light tube 14, located within a light housing 16, and a light diffusing material 18 in the form of a panel of PRISMEX (RTM) extending from the light tube 14.

Located adjacent the light diffusing panel 18 on either side is an acrylic retaining sheet 20 of PERSPEX (RTM), the retaining sheets 20 being spaced from the light diffusing panel 18 to provide a volume 22. The retaining sheets 20 are secured to the light diffusing panel 18 and the remainder of the unit 10 by means of a retaining clip 24 located on the lower edge of the unit. Similar clips may be used on the side edges of the unit, although these are not shown in the FIGS.

Access to the volume 22 between each retaining sheet and the diffusing panel 18 is provided by an elongate opening 26 formed between the edge of the retaining sheet 20 and the diffusing panel 18. It will be seen that the elongate opening 26 is located spaced from the upper and lower edges of the unit, and is parallel thereto.

The light housing 16 has a guide channel 28 formed therein, leading to the elongate opening 26; the entry into the guide channel 28 is provided with a shaped recess 30, for receiving a correspondingly-shaped reinforcing member 32 provided on the edge of an image-bearing sheet 34.

In use, the unit 11 operates as follows. The unit is typically suspended from a ceiling of a shop or the like, with the light housing 16 and elongate openings 26 being located towards the top of the unit. An image-bearing sheet 34, typically of paper or card, and with a digitally-printed image thereon, may be supported by an operator holding the reinforcing member 32, and the lower edge of the sheet 34 then inserted into the guide channel 28 formed in the light housing 16. The channel 28 leads the sheet 34 into the elongate opening 26 and thence into the volume 22 formed between the retaining sheet 20 and the diffusing panel 18. As the sheet 34 is advanced into the volume 22, gravity assists its movement downwards, while the narrowness of the volume 22 and guide channel 28 avoids wrinkling or folding of the sheet 34. Once the sheet 34 has advanced sufficiently, the reinforcing member 32 is received into and rests upon the shaped recess 30.

A second image-bearing sheet 34 may be inserted into the opposing face of the unit 10.

Once both sheets 34 have been located within the unit 10, the fluorescent light 14 may be actuated. Light is diffused throughout the diffusing panel 18, which provides an even illumination to each image-bearing sheet 34. It has also surprisingly been found that use of the light diffusing panel 18 prevents the reverse side of an image-bearing sheet 34 being seen from the opposing face of the unit.

To replace an image displayed in the unit 10, the user may simply grasp the reinforcing member 32 of the image-bearing sheet 34, and lift upwards to remove the sheet 34 from the unit 10. A replacement sheet 34 may then be inserted in the same manner as before.

The image-bearing sheets 34 may comprise digitally-printed images and the like on relatively inexpensive paper; thus it will be economical for small businesses or storekeepers to replace signage frequently. Replacement of signs may also be done with relatively little difficulty. In addition, the relative low cost of the image media used makes it economical for larger businesses also to undertake large-scale advertising or information campaigns which may be frequently updated or tailored to local conditions.

Further, the narrow width of the diffusing panel 18 and retaining sheets 20 allow illuminated signage to be located in relatively small areas, since the light source of the nit is relatively compact. In addition, many units of the present invention may be placed adjacent to one another, since access for replacing image-bearing sheets is not obstructed by close proximity of additional units, and nor is additional space necessary for bulky light boxes. The slim width of the unit further allows a unit to be placed adjacent a wall or other member if desired; of course, it will not then generally be possible to display two images on either side of the unit.

A further advantage of embodiments of the invention is that two different images may be displayed on either face of a unit, with a single light source. This again allows a greater number of signs to be displayed in a more compact area.

The invention claimed is:

1. An image display unit having a face for displaying an image, the unit comprising a light source, and retaining means for retaining an image adjacent the light source, the retaining means and the light source in combination defining a volume for receiving a sheet bearing an image, the volume having an elongate opening by which a sheet may be inserted into or removed from the volume, wherein the face has a number of edges, including a lower edge and side edges, and the elongate opening is located within the face, and spaced from said edges.

2. The unit of claim 1, wherein the light source comprises a light producing means and a light diffusing means, the light diffusing means being located substantially adjacent to and overlapping with the retaining means.

3. The unit of claim 2, wherein the light diffusing means is of polymeric material.

4. The unit of claim 2 wherein the diffusing means is an acrylic material having a matrix of dots thereon arranged to allow interaction of light between surfaces of the material.

5. The unit of claim 2, wherein the light diffusing means has a substantially planar form.

6. The unit of claim 2, wherein the unit further comprises a casing for protecting the light producing means.

7. The unit of claim 1, wherein the retaining means has a substantially planar form.

8. The unit of claim 1, wherein the retaining-means is of acrylic material.

9. The unit of claim 1, wherein the elongate opening is located towards an edge of the face.

10. The unit of claim 9, wherein the elongate opening is located in use towards an upper edge of the face.

11. The unit of claim 1, further comprising a second retaining means, volume, and opening located on an opposed side of the light source from the first retaining means, volume, and opening.

12. The unit of claim 1, further comprising a sheet bearing an image for display.

13. The unit of claim 12, wherein the sheet comprises reinforcement means along one edge of the sheet.

14. The unit of claim 13, wherein the opening of the unit is shaped to receive and retain the reinforcement means.

15. An image display unit having opposed faces for displaying images, the unit comprising a light source, and a pair of retaining means located on opposed sides of the light source for retaining images adjacent the light source, each retaining means and the light source in combination defining a volume for receiving a sheet bearing an image, the volume having an elongate opening by which a sheet may be inserted into or removed from the volume, wherein each face has a number of edges, including a lower edge and side edges, and each elongate opening is located within a respective face, and spaced from said edges.

* * * * *